United States Patent [19]

Hermann

[11] 4,175,330

[45] Nov. 27, 1979

[54] ADJUSTABLE COMPASS DEVICE

[76] Inventor: Wayne D. Hermann, 623 N. 3rd St., La Crescent, Minn. 55947

[21] Appl. No.: 962,227

[22] Filed: Nov. 20, 1978

[51] Int. Cl.[2] ..... B43L 9/04

[52] U.S. Cl. ..... 33/27 C

[58] Field of Search ..... 33/27 C, 27 R, 27 G, 33/174 B, 174 G

[56] References Cited

U.S. PATENT DOCUMENTS

| | | | |
|---|---|---|---|
| 774,365 | 11/1904 | Phenix | 33/27 C |
| 2,432,300 | 12/1947 | Ellis | 33/174 B X |
| 2,624,117 | 1/1953 | Paci | 33/27 C |
| 3,377,718 | 4/1968 | Savin et al. | 33/27 C X |

*Primary Examiner*—Charles E. Phillips
*Attorney, Agent, or Firm*—Daniel Jay Tick

[57] ABSTRACT

An annular slide member has an inner circular surface and a circular slot formed in its inner surface. The slide member is rotatably mounted for free rotation about its axis. A guide device, adjustable in length, is provided as a variable length diameter of the slide member and is fixed in the slot of the slide member so that it is freely rotatable with the slide member about the axis of the slide member for marking a circle or part of a circle of any diameter smaller than that of the slide member.

5 Claims, 3 Drawing Figures

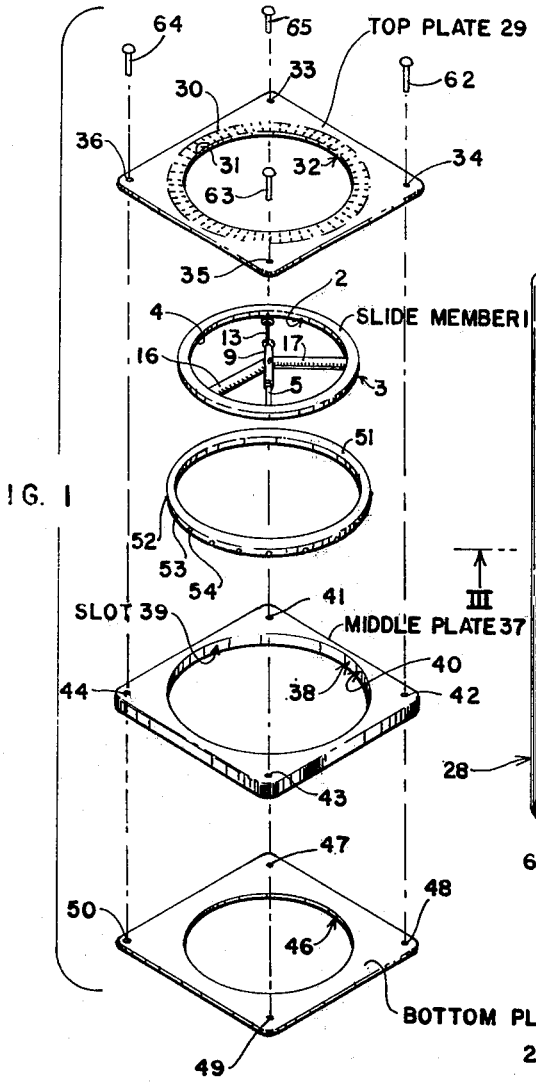
FIG. 1
FIG. 2
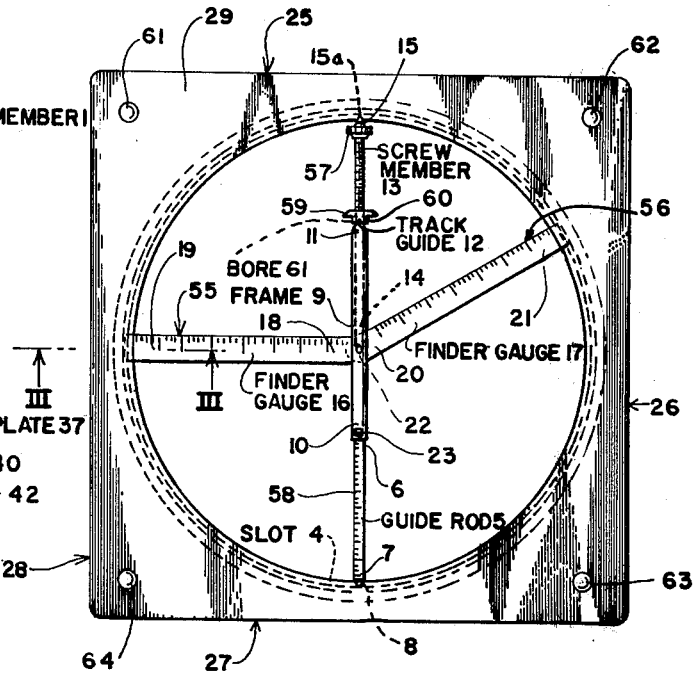
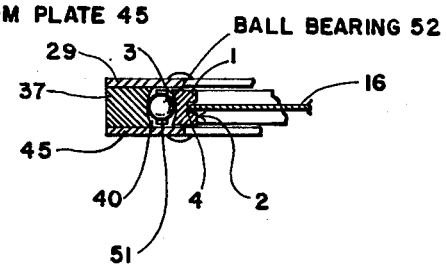
FIG. 3

ADJUSTABLE COMPASS DEVICE

BACKGROUND OF THE INVENTION

The present invention relates to an adjustable compass device. More particularly, the invention relates to an adjustable compass device for making circles and parts of circles of variable diameter.

Objects of the invention are to provide an adjustable compass device of simple structure, which is inexpensive in manufacture, assembled and used with facility, convenience and rapidity, and functions efficiently, effectively and reliably to produce circles and parts of circles of different desired diameters with great accuracy and facility.

BRIEF SUMMARY OF THE INVENTION

In accordance with the invention, an adjustable compass device for making circles and parts of circles of variable diameter comprises an annular slide member having an inner circular surface and an outer circular surface. The slide member has a circular slot formed in its inner surface. A mounting device rotatably mounts the slide member for free rotation about its axis. A guide rod has spaced opposite first and second ends, and an axial bore formed in its first end. A projection extends from the second end of the guide rod into the slot of the slide member. A tube-like frame has spaced opposite first and second ends. The frame accommodates the first end of the guide rod in the area of the first end of the frame. A track guide has a guide device for accommodating a marking device. The track guide is affixed to the second end of the tube-like frame and has an internally threaded axial bore. A screw member has spaced opposite first and second ends. The first end is accommodated in the second end of the frame and threadedly coupled in the track guide and the second end is in the slot of the slide member whereby the guide rod, the frame, the track guide and the screw member function as a variable length diameter of the slide member freely rotatable about the axis of the slide member for marking a circle or part of a circle of any diameter smaller than that of the slide member.

A pair of finder gauges of the same length are provided. Each of the finder gauges has spaced opposite first and second ends. The first end of each finder gauge is pivotally mounted under the frame on the guide rod at the center of the slide member. The second end of each finder gauge is slidably accommodated in the slot of the slide member.

A thumbwheel is coaxially affixed to the second end of the screw member.

A middle plate has a circular opening formed therethrough. An annular member mounts free-rolling ball bearings therein and is mounted in the opening of the middle plate. The slide member is mounted in the annular member.

A top plate is positioned atop the middle plate. A bottom plate is positioned beneath the middle plate. Each of the top and bottom plates has a circular opening formed therethrough. A fastening device affixes the top, middle and bottom plates to each other in coaxial parallel relation.

BRIEF DESCRIPTION OF THE DRAWINGS

In order that the invention may be readily carried into effect, it will now be described with reference to the accompanying drawings, wherein:

FIG. 1 is an exploded perspective view of an embodiment of the adjustable compass device of the invention;

FIG. 2 is a view, on an enlarged scale, of the embodiment of FIG. 1 in assembled condition, ready for use; and FIG. 3 is a cross-sectional view, on an enlarged scale, taken along the lines III—III, of FIG. 2.

DETAILED DESCRIPTION OF THE INVENTION

The adjustable compass device of the invention is used to make circles and parts of circles of variable diameter.

The adjustable compass device of the invention comprises an annular slide member 1 (FIGS. 1 and 3) having an inner circular surface 2 and an outer circular surface 3 (FIGS. 1 and 3). The slide member 1 has a circular slot 4 formed in its inner surface 2, as shown in FIGS. 1 and 3.

A mounting device, hereinafter described, rotatably mounts the slide member 1 for free rotation about its axis.

A guide rod 5 has spaced opposite first and second ends 6 and 7, as shown in FIG. 2. The guide rod has an axial bore (not shown in the FIGS.) formed in its first end 6 and an axial projection 8 (FIG. 2) extending from its second end 7 and fixed in the slot 4 of the slide member 1.

A tube-like frame 9 has spaced first and second ends 10 and 11, as shown in FIG. 2. The frame 9 accommodates the first end 6 of the guide rod 5 in the area of the first end 10 of said frame. The frame 9 has a track guide 12 affixed to its second end 11, as shown in FIG. 2. The frame 9 has lengthwise slots in its diametrically opposite sides to slidably accommodate finder gauges. The frame 9 and the track guide 12 together have the same length as the radius of the slide member 1 when the combined length of said frame and said track guide is measured from the notch of said track guide, as hereinafter described, to the first end 10 of said frame.

A screw member 13 has spaced opposite first and second ends 14 and 15, as shown in FIG. 2. The first end 14 and the area of said first end of the screw member 13 are accommodated in the second end 11 of the frame 9 and is threadedly coupled to the trace guide 12. The track guide 12 is affixed to the second end 11 of the frame 9 (FIG. 2). The first end 14 of the screw member 13 has an axial projection extending therefrom (not shown in the FIGS.). The axial projection of the first end 14 of the screw member 13 is accommodated in the axial bore formed in the first end 6 of the guide rod 5. The second end 15 of the screw member 13, although fixed in the slot 4 of the slide member 1 via an axial projection **15*a*, as shown in FIGS. 1 and 2, is rotatable about its axis. The length of the screw member 13, from its first end 14 to its second end 15**, without its axial projections, is equal to the radius of the slide members.

The guide rod 5, the frame 9 and the screw member 13 thus function as a variable length diameter of the slide member 1, freely rotatable, with the slide member, about the axis or center of said slide member for marking a circle or part of a circle of any diameter smaller than that of said slide member. This is accomplished by placing a marking instrument such as, for example, a pencil, pen, or the like, at a desired point on the diameter member 5, 9, 13, as hereinafter described, and rotating said diameter member, with the slide member 1, about the center of said slide member.

A pair of finder gauges 16 and 17 of the same length are provided (FIGS. 1 and 2). The finder gauge 16 has spaced opposite first and second ends 18 and 19, respectively, and the finder gauge 17 has spaced opposite first and second ends 20 and 21, respectively (FIG. 2). The first ends 18 and 20 of the finder gauges 16 and 17, respectively, are pivotally mounted under the frame 9 on the guide rod 5 via a pivot pin 22, at the center of the slide member 1, as shown in FIG. 2. The first end 6 of the guide rod 5 accepts the pivot pin 22. The second end 19 of the finder gauge 16 and the second end 21 of the finder gauge 17 are slidably accommodated in the slot 4 of the slide member 1, as shown in FIG. 2.

The adjustable compass device of the invention is used by rotating the screw member 13 about its axis to a desired diameter of a circle to be drawn. The diameter is indicated by scale indications formed on the guide rod 5. The scale indication shown in a window 23 at the first end 10 of the frame 9 indicates the diameter of the circle. The device is placed on a flat surface to be marked and is held in a stationary position. The marking point of a marking device such as, a pencil, pen or the like, is then placed in the track guide 12, which is affixed to the second end 11 of the frame 9, as hereinbefore described, and is applied to the surface to be marked. In accordance with the movement of the marking device with the diameter member 5, 9, 13 clockwise or counterclockwise, a desired distance, a circle or part of a circle is produced on the surface to be marked.

The device of the invention thus eliminates the need for making a hole in a drawing surface, as results from the use of known types of circle compasses and has two graduated degree scales for plotting and measuring angles and guiding any size circle or arc an exact number of degrees, so that it is considerably more versatile than a protractor. The device of the invention also provides the same precision as a circle template, but utilizes considerably less space and provides an infinitely greater number of circles. The device of the invention may be adjusted via its screw member 13 for a very high degree of accuracy and provides easy and accurate indications of any diameter via its cursor indicator at the window 23 of the frame 9.

The finder gauges 16 and 17 are utilized to determine where a particular circle or part of a circle starts and ends.

Ink runs are avoided by the device of the invention, since it tracks in a plane spaced above the drawing surface. A T-square is used with great facility with the device of the invention, due to its perpendicularly disposed edges 25, 26, 27 and 28, as shown in FIG. 2.

The mounting device comprises a top plate 29 (FIGS. 1 to 3). The top plate 29 is a thin plate having two graduated degree scales 30 and 31 engraved thereon around a central circular opening 32 formed therethrough, as shown in FIG. 1. The opening 32 is slightly larger in diameter than the largest circle which may be drawn with the device. The top plate 29 has four rivet holes 33, 34, 35 and 36 in the corresponding four corners thereof. The edges of the top plate are equal in length and are mutually perpendicular, since said top plate is a square.

The mounting device further comprises a middle plate 37 having a central circular hole 38 formed therethrough of a diameter slightly larger than the hole 32 of the top plate 29. The middle plate 37 has a considerably greater thickness than the top plate 29, as shown in FIGS. 1 and 3. A circular slot 39 is formed in the inner surface 40 of the middle plate 37. The middle plate 37 has the same configuration as the top plate 29 and has rivet holes 41, 42, 43 and 44 in its corresponding corner.

The mounting device further comprises a bottom plate 45 (FIGS. 1 and 3) of the same configuration as the top and middle plates 29 and 37, respectively, and having a central circular hole 46 formed therethrough. The bottom plate 45 has the same dimensions as the plate 29 and its circular hole 46 has the same diameter as said top plate. Four rivet holes 47, 48, 49 and 50 are formed through the four corners of the bottom plate 45.

The last part of the mounting device is an annular member 51, shown in FIGS. 1 and 3, mounting a plurality of ball bearings 52, 53, 54, and so on, as shown in FIG. 1. The inner diameter of the annular member 51 is slightly greater than the diameter of the holes 32 and 46 of the top and bottom plates 29 and 45, respectively, and the outer diameter of said member is slightly less than the diameter of the circular hole 38 of the middle plate 37. The annular member 51 has a slightly smaller thickness than the middle plate 37 and accommodates free rolling ball bearings in equiangularly spaced holes formed therein. The ball bearings 52, 53, 54, and so on, have a diameter slightly smaller than the thickness of the annular member 51.

As shown in FIG. 1, the slide member 1 has an inner diameter which is slightly less than that of the holes 32 and 46 through the top and bottom plates 29 and 45, respectively. The slide member 1 has a thickness approximately equal to that of the diameter of the ball bearings. The thicknesses of the top plate 29, the middle plate 37, the bottom plate 45, the annular member 51 and the slide member 1 are measured in directions parallel to the axes of such members.

The finder gauges 16 and 17 consist of two thin strips of material, each engraved along the top edges 55 and 56, respectively, (FIG. 2), with scale indications. Each of the finder gauges 16 and 17 has a length slightly greater than the radius of the slide member 1, and said finder gauges are pivotally mounted via said pivot pin 22, as hereinbefore described.

A thumbwheel 57 is permanently coaxially affixed to the second end 15 of the screw member 13.

The projecting portion 8 at the second end 7 of the guide rod 5 is substantially rectangular and flat. The guide rod 5, itself, has an essentially flattened face engraved with scale indications 58, as shown in FIG. 2. The length of the guide rod 5, exclusive of its rectangular projection 8, is equal to the radius of the slide member 1.

The track guide 12 is a disc having a top half 59 and a bottom half 60 (FIG. 2). The top half 59 of the track guide 12 has a slightly greater diameter than the bottom half 60 thereof, thereby providing an annular notch for accommodating a marking device. The track guide 12 also has an internally threaded axial or center bore 61, as shown in FIG. 2.

The cursor indicator 23 is, as hereinbefore described, a window at the first end of the frame 9. It has a hairline extending across its middle, as shown in FIG. 2.

The affixing of the track guide 12 to the second end 11 of the frame 9 provides a guide gauge which is completed by inserting a cursor indicator member so that its indications are seen at the window 23.

Four rivets 62, 63, 64 and 65 (FIGS. 1 and 2) are used to assemble the device of the invention by affixing the top plate 29 to the bottom plate 45 with the middle plate 37 sandwiched therebetween.

As shown in FIG. 2, the assembled device is provided by rotating the threaded first end 14 of the screw member 13 into the track guide 12 which is affixed to the second end 11 of the frame 9 and, more particularly, into the internally threaded bore 61 of the guide gauge, so that said track guide is essentially next-adjacent the thumbwheel 57. The round pinhole of the guide rod 5 is then inserted through the tubular opening at the first end 10 of the frame 9 of the guide gauge, so that a round pin extending from the first end 14 of the screw member 13 is accommodated in said pinhole. The screw member 13, the guide gauge and the guide rod 5 are then calibrated as a unit and are inserted as a unit into the slide member 1 so that the rectangular projection 8 of said guide rod is accommodated in the slot 4 of said slide member and the round pin at the second end 15 of said screw member is accommodated in said slot 4. The finder gauges 16 and 17 are then mounted on guide rod 5, under the frame 9 so that the second ends 19 and 21, respectively, are accommodated in the slot 4 of the slide member 1. This enhances the stability of the device.

In the actual assembly of the device, the middle plate 37 is placed atop the bottom plate 45. The annular member 51 is then inserted in the opening 38 of the middle plate 37 along with the bearings. The slide member 1 is then positioned within the annular member 51. Finally, the top plate 29 is placed atop the middle plate 37 and the three plates are riveted to each other.

While the invention has been described by means of a specific example and in a specific embodiment, I do not wish to be limited thereto, for obvious modifications will occur to those skilled in the art without departing from the spirit and scope of the invention.

I claim:

1. An adjustable compass device for making circles and parts of circles of variable diameter, said adjustable compass comprising an annular slide member having an inner circular surface and an outer circular surface, said slide member having a circular slot formed in its inner surface;

mounting means for rotatably mounting the slide member for free rotation about its axis;

a guide rod having spaced opposite first and second ends, said guide rod having an axial bore formed in its first end and a projection extending from its second end into the slot of the slide member;

a tube-like frame having spaced opposite first and second ends, said frame accommodating the first end of the guide rod in the area of the first end of said frame;

a track guide having guide means for accommodating a marking device, said track guide being affixed to the second end of said tube-like frame and having an internally threaded bore; and a screw member having spaced opposite first and second ends, the first end being accommodated in the second end of the frame and threadedly coupled in said track guide and the second end being in the slot of the slide member whereby the guide rod, the frame, the track guide and the screw member function as a variable length diameter of the slide member freely rotatable about the axis of said slide member for marking a circle or part of a circle of any diameter smaller than that of said slide member.

2. An adjustable compass device as claimed in claim 1, further comprising a pair of finder gauges of the same length each having spaced opposite first and second ends, the first end of each finder gauge being pivotally mounted under the frame on the guide rod at the center of the slide member and the second end of each finder gauge being slidably accommodated in the slot of the slide member.

3. An adjustable compass device as claimed in claim 1, further comprising a thumbwheel coaxially affixed to the second end of the screw member.

4. An adjustable compass device as claimed in claim 1, further comprising a middle plate having a circular opening formed therethrough, and an annular member mounting free-rolling ball bearings therein mounted in the opening of the middle plate, said slide member being mounted in the annular member.

5. An adjustable compass device as claimed in claim 4, further comprising a top plate atop the middle plate, a bottom plate beneath said middle plate, each of said top and bottom plates having a circular opening formed therethrough, and fastening means affixing said top, middle and bottom plates to each other in coaxial parallel relation.

* * * * *